US009638047B1

(12) United States Patent
Jones

(10) Patent No.: US 9,638,047 B1
(45) Date of Patent: May 2, 2017

(54) MULTIPLE WALL IMPINGEMENT PLATE FOR SEQUENTIAL IMPINGEMENT COOLING OF AN ENDWALL

(71) Applicant: Russell B Jones, North Palm Beach, FL (US)

(72) Inventor: Russell B Jones, North Palm Beach, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 371 days.

(21) Appl. No.: 14/533,239

(22) Filed: Nov. 5, 2014

Related U.S. Application Data

(60) Provisional application No. 61/905,350, filed on Nov. 18, 2013.

(51) Int. Cl.
*F01D 5/18* (2006.01)
*F01D 9/04* (2006.01)

(52) U.S. Cl.
CPC ..... *F01D 5/188* (2013.01); *F01D 9/041* (2013.01); *F05D 2260/201* (2013.01)

(58) Field of Classification Search
CPC ..... F01D 5/182; F01D 5/186; F01D 5/187; F01D 5/188; F01D 9/041; F01D 9/065; F01D 25/12; F05D 2260/202
USPC ..... 415/115, 116; 416/96 R, 97 R
See application file for complete search history.

(56) References Cited

U.S. PATENT DOCUMENTS 4,573,865 A * 3/1986 Hsia ..... F01D 5/187 165/109.1
6,419,445 B1 * 7/2002 Burdgick ..... F01D 9/04 415/116
7,097,418 B2 * 8/2006 Trindade ..... F01D 5/18 415/115
2013/0051972 A1 * 2/2013 Romanov ..... F01D 11/08 415/1
2013/0280081 A1 * 10/2013 Propheter-Hinckley F01D 5/187 416/223 R

* cited by examiner

*Primary Examiner* — Dwayne J White
*Assistant Examiner* — Peter T Hrubiec
(74) *Attorney, Agent, or Firm* — John Ryznic

(57) ABSTRACT

An air cooled turbine airfoil with an impingement plate bonded over multiple impingement cooling surfaces of the airfoil, where the impingement plate forms a series of double or triple impingement cooling for separate surfaces of the airfoil. The impingement plate can be shaped and sized to fit over an airfoil surface that requires multiple impingement cooling.

16 Claims, 6 Drawing Sheets

MULTIPLE WALL IMPINGEMENT PLATE FOR SEQUENTIAL IMPINGEMENT COOLING OF AN ENDWALL

CROSS-REFERENCE TO RELATED APPLICATIONS

This application claims the benefit to Provisional Application 61/905,350 filed on Nov. 18, 2013 and entitled MULTIPLE WALL IMPINGEMENT PLATE FOR SEQUENTIAL IMPINGEMENT COOLING OF AN ENDWALL.

GOVERNMENT LICENSE RIGHTS

None.

BACKGROUND OF THE INVENTION

Field of the Invention

The present invention relates generally to a gas turbine engine, and more specifically to sequential cooling of a stator vane endwall or airfoil.

Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

BRIEF SUMMARY OF THE INVENTION

An air cooled turbine airfoil with multiple impingement cooling surfaces over which an impingement plate is bonded to form double or triple impingement cooling circuits for the airfoil. A double impingement cooling plate is formed by inner and outer plates bonded over the airfoil surface that form a first impingement cooling path for a first impingement cooling surface and a second impingement cooling path for a second impingement cooling surface, where the impingement cooling air flows in series to the first impingement surface and then to the second impingement cooling surface.

In another embodiment, an impingement plate forms triple impingement cooling for three impingement cooling surfaces.

The impingement cooling plates can be shaped to fit over two or three impingement surfaces on an airfoil in which each impingement surface is separated by a rib. When the impingement plate is bonded over the impingement surfaces separated by a rib or ribs, three separate impingement cooling paths are formed.

DETAILED DESCRIPTION OF THE INVENTION

The present invention is a sequential cooling insert that can be installed within an air cooled turbine airfoil to provide sequential cooling to the airfoil wall or a platform or endwall of the airfoil such as a turbine stator vane. The sequential cooling insert can be a double or triple sequential cooling insert in which the cooling air passes in series to provide cooling for two (double impingement) or three (triple impingement) surfaces of the airfoil that require cooling. The insert can be shaped so that the insert can be installed between existing ribs that separate impingement cavities of the airfoil or endwall or platform. Thus, the sequential cooling inserts of the present invention can be used in pre-existing airfoils without requiring any redesign of the impingement cooling surfaces or ribs separating adjacent impingement cooling surfaces. The insert can be shaped to fit within the pre-existing impingement surfaces. The older non-sequential impingement cooled airfoil can thus be refitted with the sequential cooling inserts to provide improved cooling.

Figure 1:
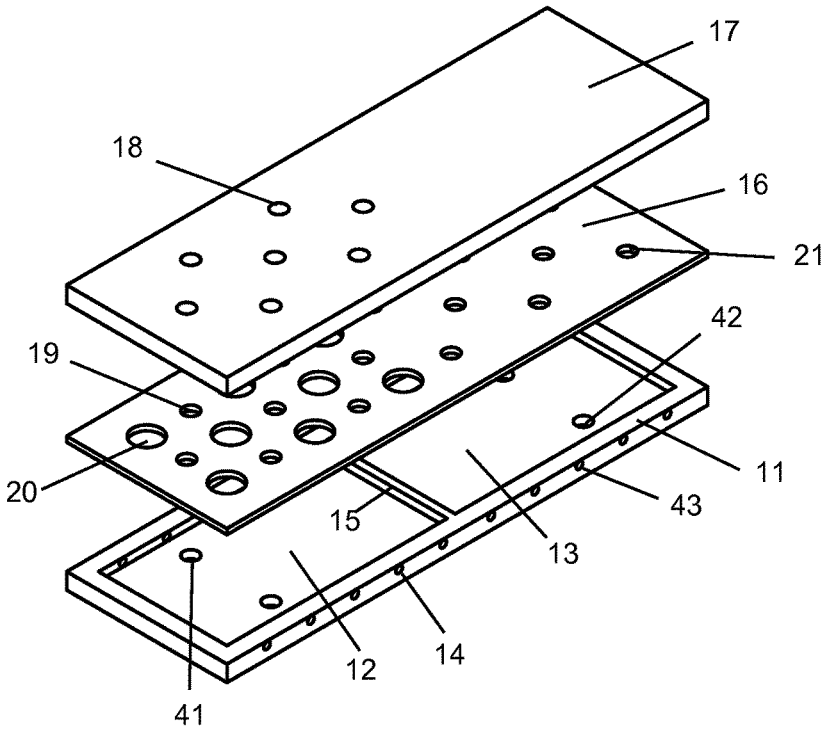
FIG. 1 shows an exploded view of a double sequential impingement cooling insert for an airfoil in a first embodiment of the present invention.
Figure 2:
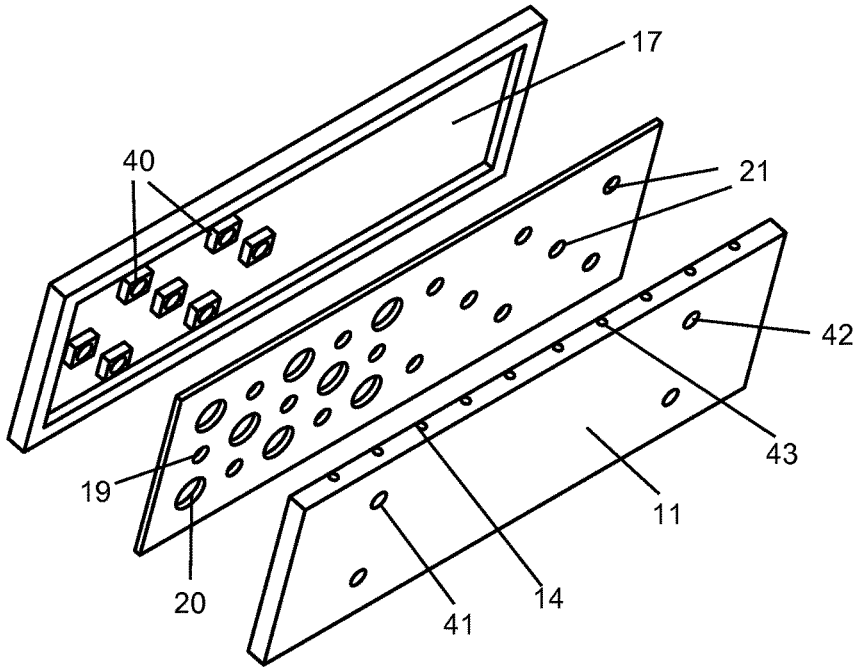
FIG. 2 shows an exploded view of the double sequential impingement cooling insert of FIG. 1 from a bottom side.
Figure 8:
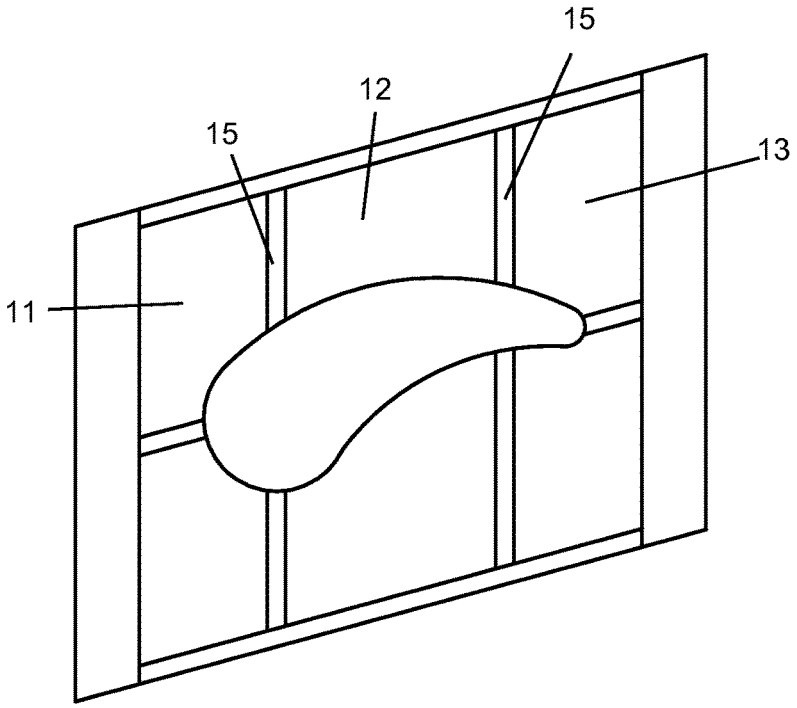
FIG. 8 shows a top view of an endwall of a vane segment with six separated impingement cooling cavities in which the sequential impingement cooling inserts of the present invention can be used.
Figure 9:
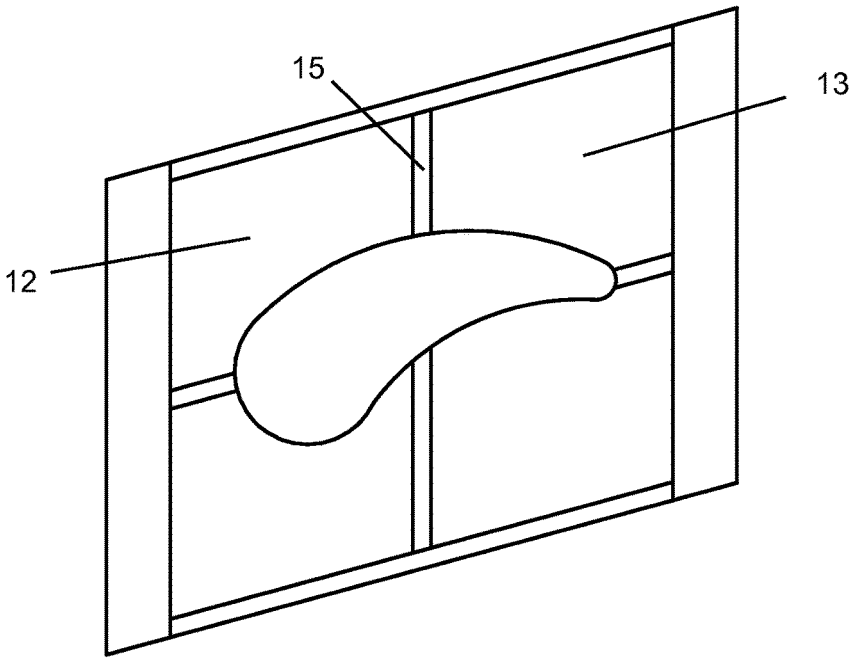
FIG. 9 shows a top view of an endwall of a vane segment with four separated impingement cooling cavities in which the sequential impingement cooling inserts of the present invention can be used.

FIGS. 1 and 2 show top and bottom views of the first embodiment of the present invention in which the sequential cooling insert provides double impingement of a surface. For example, a turbine stator vane includes an endwall that requires impingement cooling. Typically, an endwall is separated into multiple impingement cavities. FIG. 8 shows one endwall with six separate impingement cavities 12 while FIG. 9 shows an endwall with only four separated impingement cavities. The impingement cavities are separated by ribs 15. The cavities 12 and ribs 15 are all formed as an integral part of the endwall.

The double sequential cooling insert of FIG. 1 includes a surface 11 that requires impingement cooling which could be an endwall of a stator vane or a platform of a rotor blade or an inner wall of an airfoil of a stator vane. The surface 11 is part of the airfoil that will be cooled by impingement cooling air. The surface 11 includes two impingement cavities separated by a rib 15 with a first impingement cavity 12 and a second impingement cavity 13. Each impingement cavity 12 and 13 can include an arrangement of discharge holes 14 and 43 to discharge the spent impingement cooling air from the cavity.

In FIG. 1, the outer plate 17 includes an arrangement of cooling air supply holes 18 that are supplied with cooling air from an external source of cooling air, where the cooling air supply holes 18 are aligned and sealed with stand-offs 40 extending from a bottom surface with first impingement cooling holes 19 formed on the inner plate 16. The stand offs 40 could be added material to plate 17, integrally machined to plate 17, or tubes passing through each plate 17 and 16, sealed at each intersection. The outer plate 17 and the inner plate 16 are both sealed and bonded together and then sealed and secured over the cavities 12 and 13 of the airfoil surface 11 that requires the impingement cooling, such as on the surface opposite the gas path of a turbine vane endwall, or blade outer air seal, etc. The inner plate 16 also includes an arrangement of return air holes 20 that are equal or larger in diameter than the cooling air supply holes 18 and first impingement cooling holes 19 in order to reduce pressure drops. The inner plate 16 also includes an arrangement of second impingement cooling holes 21 located over the second impingement cavity 13. The inner plate 16 and the outer plate 17 are separate pieces from the airfoil and are bonded over the airfoil surface 11 that requires the impingement cooling.

FIG. 2 shows an underside view of the outer plate 17 in which the cooling air supply holes 18 include standoffs 40 that seals the cooling air passage between the outer plate 17 and the inner plate 16. A space formed around the standoffs 40 and between the outer plate 17 and the inner plate 16 forms a flow path for the cooling air return from the first impingement cavity 12 to deliver to the second impingement cavity 13.

Operation of the double impingement cooling insert of FIGS. 1 and 2 is described as follows. Cooling air from an external source (such as a compressor of a gas turbine engine) passes through the cooling air supply holes 18 in the outer plate 17 and then through the first impingement cooling holes 19 in the inner plate 16 and impinge on the surface of the first impingement cavity 12. The spent impingement cooling air from the first impingement cavity 12 will then flow through the larger return air holes 20 in the inner plate 16 and flow through the space formed between the outer plate 17 and the inner plate 16 and around the stand-offs 40 to the space above the second impingement holes 21. The cooling air then impinges through the second impingement cooling holes 21 onto the surface of the second impingement cavity 13. The spent impingement cooling air can then be discharged though the discharge holes 43 arranged along the second impingement cavity 13, or through film holes 41 on the gas path side of the surface 11, or directed to other channels to discharge the flow 42.

In the double sequential impingement cooling insert of FIG. 1, the insert can be used on the endwall shown in FIG. 9 where the first impingement cavity 12 is located above the endwall surface having the highest hot gas stream pressure and the second impingement cavity 13 is located above the endwall surface having a lower hot gas stream pressure. This arrangement provides back flow margin of the cooling circuit in the case of a crack oxidation or damage to the cooled surface 12 resulting in a hole. This method of maintaining backflow margin of the pressure in impingement zone 12 to the gas path surface pressure opposite 12, and of the pressure in impingement zone 13 to the gas path surface pressure opposite 13 is seen as a requirement for robust damage tolerant design. These embodiments could be applied to designs without maintaining back flow margin that would carry additional risk if damaged.

Figure 3:
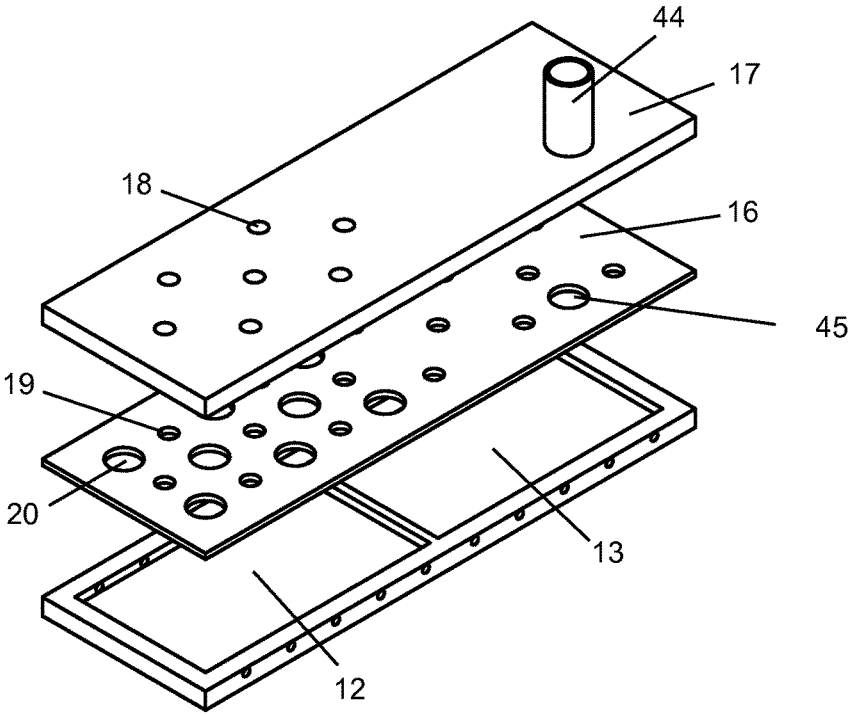
FIG. 3 shows an exploded view of a double sequential impingement cooling insert with a return tube.
Figure 4:
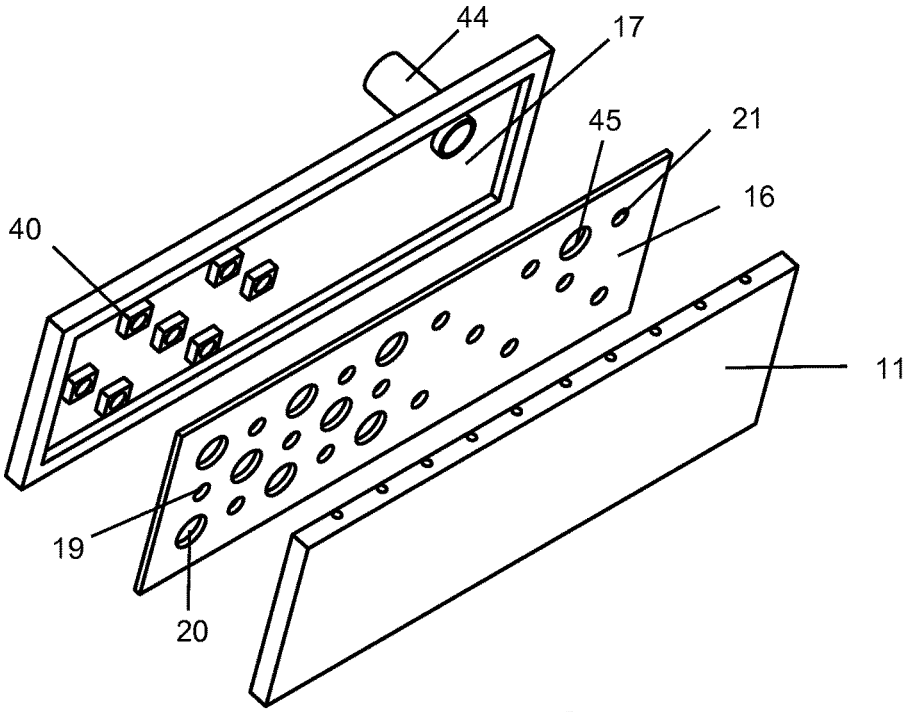
FIG. 4 shows an exploded view of the double sequential impingement cooling insert of FIG. 3 from a bottom side.

In the FIGS. 1 and 2 embodiment, the first impingement cavity 12 can have the first discharge holes 14 to provide cooling for an area of the endwall, and or first film holes 41 or can be without either discharge holes 14 or without film holes 41 so that all of the first impingement cooling air then flows to the second impingement cooling cavity 13. In other embodiments, the second impingement cooling cavity 13 can be without discharge holes 43 or film holes 42 so that all of the impingement cooling air can be sent to another location of the airfoil such as an internal cooling circuit within the airfoil section of the stator vane. In this embodiment, another arrangement of one or more return holes 44 would be required in the inner plate 16 above the second impingement cavity 13 in order to collect the post impingement surface 13 cooling air for use elsewhere. This embodiment with the return hole 44 is shown in FIGS. 3 and 4 and are connected to the second impingement cavity 13 through holes 45 formed in the inner plate that are aligned with the return air holes 44 in the outer plate 17.

Figure 5:
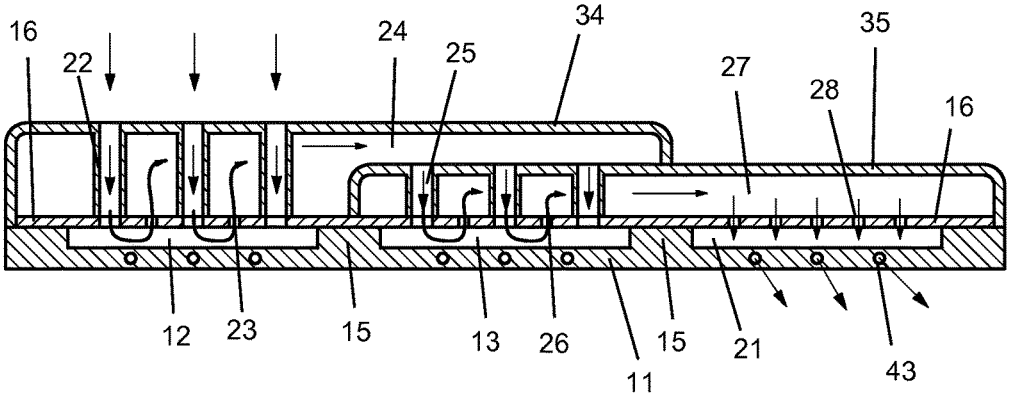
FIG. 5 shows a cross section view of a triple sequential impingement cooling insert for an airfoil in a second embodiment of the present invention.

FIG. 5 shows another embodiment in which the sequential impingement insert provides cooling to three impingement surfaces in series. This could be used to provide impingement cooling to the endwall in FIG. 8 in which two of the inserts would provide cooling for the series of separate impingement cavities 12, 13, 21. FIG. 5 shows the endwall surface 11 with first impingement cavity 12, second impingement cavity 13, and third impingement cavity 21 separated by ribs 15. The insert assembly is secured and sealed over the endwall 11 and the impingement cavities separated by ribs 15. The insert assembly in FIG. 5 include an inner plate 16 having both impingement holes 22 and return holes 23.

A first outer plate 34 is bonded to the inner plate 16 and includes first impingement tubes 22 that form a closed cooling passage from outside to the first impingement cavity 12. Return holes 23 connect the first impingement cavity 12 to a first sealed space 24 formed between the first outer plate 34 and the inner plate 16. The first sealed space 24 is connected to an arrangement of second impingement tubes 25 that open into the second impingement cavity 13. Return holes 26 formed in the lower plate 16 connect the second impingement cavity 13 to a second sealed space 27 formed between a second outer plate 35 and the inner plate 16 and around the impingement tubes.

The second sealed space 27 below outer plate 35 supplies the air exhausted from the second chamber through holes 26 to impingement holes 28 formed in the inner plate 16 that discharge into the third impingement cavity 21. Discharge holes 43 can also be used to discharge the spent impingement cooling air from the third impingement cavity 21. Discharge holes 43 can also be used in the first and second impingement cavities 12 and 13. In another embodiment, the third impingement cavity 21 can be connected to another cooling circuit with the use of a third arrangement of return holes (like 44 and 45 in FIGS. 3 and 4) formed between the second outer plate 35 and the inner plate 16 like the return hole passages 25.

Figure 6:
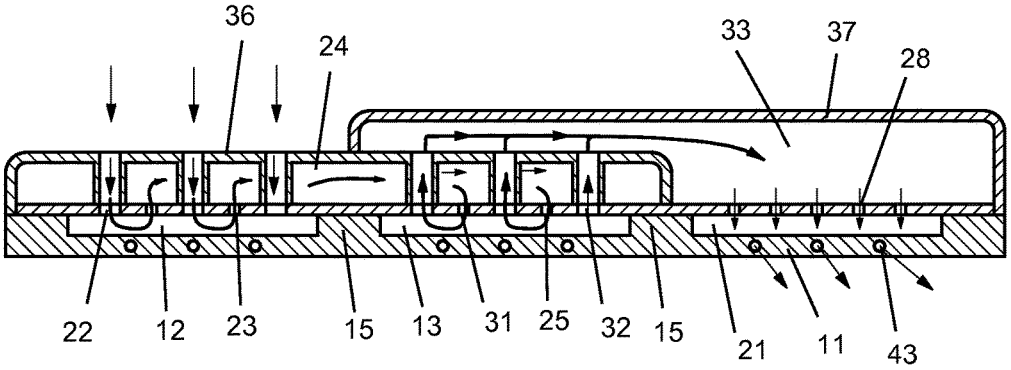
FIG. 6 shows a cross section view of a triple sequential impingement cooling insert for an airfoil in a third embodiment of the present invention.

FIG. 6 shows another embodiment of the triple impingement insert of the present invention. A first outer plate 36 is located inside of a second outer plate 37. The endwall or airfoil surface 11 still has the three impingement cavities 12, 13 and 21 like in the FIG. 5 embodiment. The first outer plate 36 includes first impingement tubes 22 that open into the first impingement cavity 12. First return holes 23 open into the first sealed space 24 and connect to second impingement holes 31 into the second impingement cavity 13. Second return holes are formed in the tubes 32 that open into a second sealed space 33 connected to the third impingement holes 28 that open into the third impingement cavity 21. Discharge holes 13 can be used in any of the three impingement cavities 12, 13 and 21.

Figure 7:
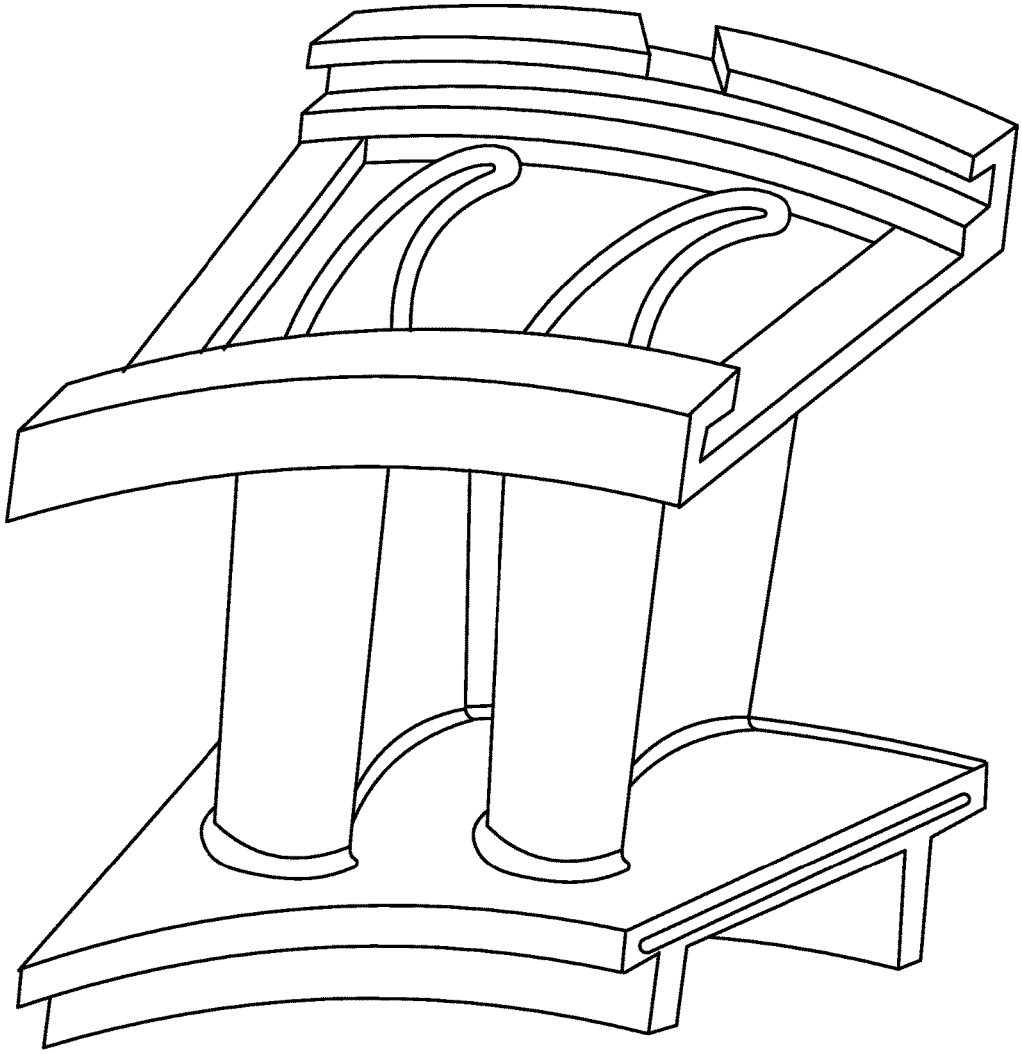
FIG. 7 shows a top view of a stator vane segment with two airfoils in which the sequential impingement cooling insert of the present invention can be used.

FIG. 7 shows a stator vane with two endwalls in which the sequential impingement inserts of the present invention can be used to provide improved impingement cooling with less cooling air than the prior art stator vane endwall impingement cooling. The prior art impingement cooling includes several impingement plates secured over the impingement cavities formed by ribs on the outside surfaces of the endwalls. As such, the cooling air for each of the impingement cavities is supplied from cooling air located above the impingement plates that flows in parallel and not in series. Thus, the same impingement cooling air pressure is provided for all of the separate impingement cavities. The impingement cavity located near to the trailing edge section and on the suction side of the airfoil would have the lowest external hot gas pressure and thus the backflow margin would be high. The impingement cooling air pressure for the impingement cavity 12 would need to be higher than that from the middle impingement cavity 13, which would need to be higher than the trailing edge impingement cavity 21. Supplying pressurized cooling air at the same pressure to each of these three impingement cavities 12, 13 and 21 without the presence of ribs 15 creating separate compartments, the cooling would be insufficient because of variation in the external hot gas flow pressure. More cooling air would flow out from the trailing edge cavity 21 than in the leading edge cavity 12 and thus the T/E cavity 21 would be over-cooled while the L/E cavity 12 would be under-cooled.

With the insert of the present invention, each insert could be shaped to fit over any of the cavities on the endwall 12, 13 and 21 and connected in series so that the highest impingement cooling pressure would be available for the first impingement cavity 12, a lower impingement pressure using the same or most of the same cooling air would be available for the second impingement cavity 13, and then the lowest impingement pressure would be available for the third impingement cavity 21 using most or all of the impingement cooling air from the first and second impingement cavities 12 and 13. An airfoil with an older parallel cooling flow design could be retrofitted with the sequential impingement cooling inserts with only minor modification to the vane.

FIG. 9 endwall with only two cavities having different pressure requirements can be cooled using the double sequential cooling insert of FIGS. 1 and 2. Each insert is shaped to fit securing over the impingement cavities 12 and 13 to provide impingement cooling in series.

Figure 10:
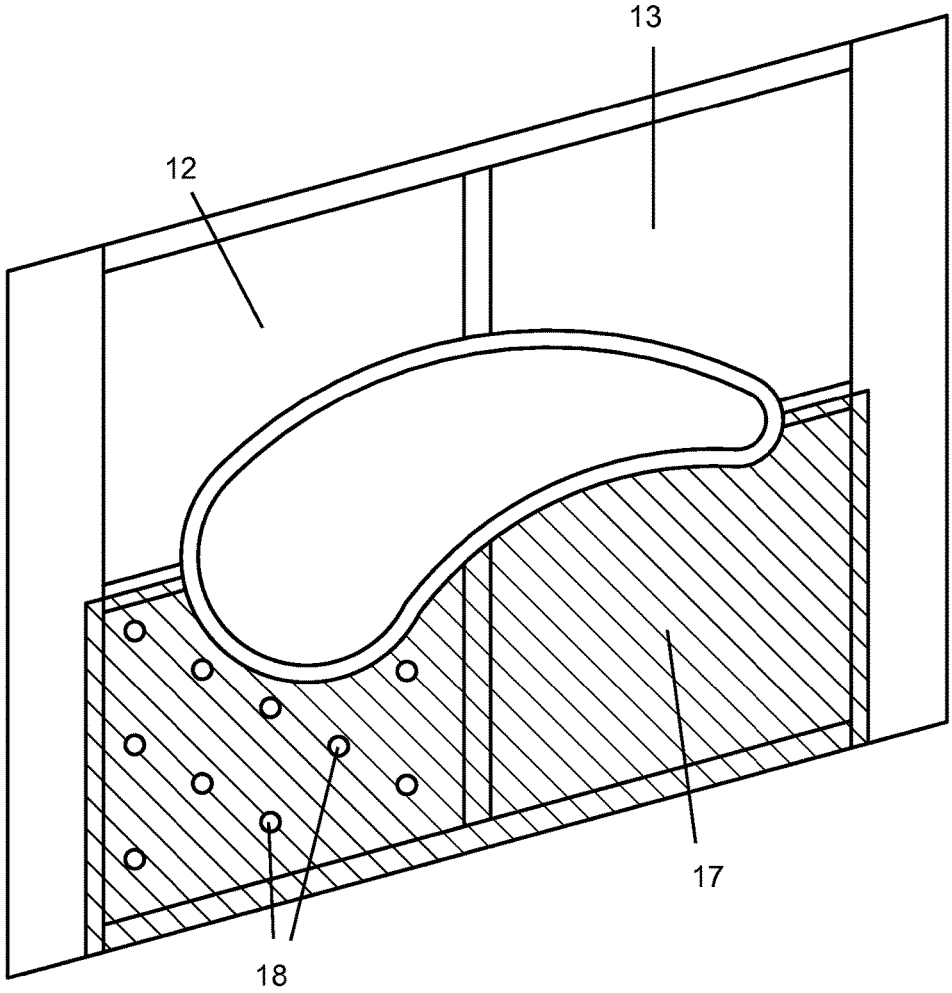
FIG. 10 shows a top view of an endwall having four separated impingement cooling cavities with one of the double sequential impingement cooling insert secured over two of the cavities according to the present invention.

FIG. 10 shows an endwall with four impingement cavities separated by ribs. One of the double sequential impingement cooling inserts of the present invention is secured over two of the impingement cavities 12 and 13. The first impingement holes 18 open on the top plate 17 of the insert to supply cooling air from above the endwall of the vane.

In each of the impingement inserts of the present invention, the spent impingement cooling air can be delivered to another cooling circuit after the last impingement cavity instead of discharging the spent cooling air through the discharge holes 13, 42 and or film holes 41, 42. The spent impingement cooling air from the last impingement cavity can be used in another impingement insert or in a cooling circuit within the airfoil of the vane segment. With the sequential impingement cooling inserts of the present invention, a several cavities can be cooled in series each having a different pressure so that more surface can be cooled using the same or almost the same cooling air but with different cooling air pressures in order to maintain backflow margin requirements without over-cooling or under-cooling the different impingement cavities.

The sequential impingement cooling inserts of the present invention have been mostly described for use in an endwall of the stator vane segment, but could also be used in an airfoil in which radial of spanwise extending ribs are used. The inserts can be secured between these ribs to provide a series of impingement cooling for the airfoil wall.

I claim:

1. An air cooled turbine airfoil comprising:

an airfoil having a leading edge region, a trailing edge region, a pressure side wall, and a suction side wall;

a first impingement surface and a second impingement surface of the airfoil separated by a rib;

an inner plate bonded over the first impingement surface and the second impingement surface;

the inner plate having an arrangement of first impingement cooling holes over the first impingement surface and second impingement cooling holes over the second impingement surface;

the inner plate having an arrangement of return air holes in a section over the first impingement surface;

an outer plate bonded over the inner plate to form a first impingement cooling chamber separated from a second impingement cooling chamber; and, the outer plate having an arrangement of cooling air supply holes and standoffs extending from a bottom side and aligned with the first impingement cooling holes to form a closed cooling air passage; wherein, cooling air from an external source flows through the cooling air supply holes in the outer plate and through the standoffs and the first impingement cooling air holes to provide impingement cooling to the first impingement surface, flows through the return air holes, and then through the second impingement cooling holes to provide impingement cooling to the second impingement surface.

2. The air cooled turbine airfoil of claim 1, and further comprising:

the return air holes are of larger diameter than the cooling air supply holes and the first impingement cooling holes.

3. The air cooled turbine airfoil of claim 1, and further comprising:

The second impingement surface includes an arrangement of discharge holes to discharge the impingement cooling air from the airfoil.

4. The air cooled turbine airfoil of claim 1, and further comprising:

the outer plate includes a return air hole over the second impingement cooling surface to discharge cooling air from the second impingement cooling chamber.

5. The air cooled turbine airfoil of claim 1, and further comprising:

the first and second impingement cooling surfaces are on an endwall of a turbine stator vane.

6. An air cooled turbine airfoil comprising:

an airfoil having a leading edge region, a trailing edge region, a pressure side wall, and a suction side wall;

a first impingement cavity, a second impingement cavity, and a third impingement cavity of the airfoil each separated by a rib;

an inner plate bonded over the first and second and third impingement cavities;

the inner plate having an arrangement of first impingement cooling holes over the first impingement cavity, an arrangement of second impingement cooling holes over the second impingement cavity, and an arrangement of third impingement cooling holes over the third impingement cavity;

a first outer plate having first impingement tubes aligned with the first impingement cooling holes to supply cooling air to the first impingement cooling holes;

a second outer plate having second impingement tubes aligned with the second impingement cooling holes to supply cooling air to the second impingement cooling holes;

the inner plate having an arrangement of first return air holes over the first impingement cavity and an arrangement of second return air holes over the second impingement cavity; and, the inner plate and the first and second outer plates forming a series of three impingement cooling paths in which cooling air from the first impingement tubes flow through the first impingement cooling holes, through the first return air holes, through the second impingement tubes, through the second impingement cooling holes, through the second return air holes, and then through the third impingement cooling holes.

7. The air cooled turbine airfoil of claim 6, and further comprising:

the inner plate and the first and second outer plates form a first sealed space and a second sealed space that each forms a cooling air flow path from an upstream arrangement of return air holes to a downstream arrangement of impingement cooling air holes.

8. The air cooled turbine airfoil of claim 6, and further comprising:

a plurality of discharge cooling holes connected to each of the first and second and third impingement cavities to discharge cooling air from the impingement cavity.

9. A process for modifying an air cooled turbine endwall from a single impingement to a double impingement, the endwall having a hot side exposed to a hot gas stream and a cold side having a first impingement surface and a separate impingement surface separated by a rib, the process comprising the steps of:

forming an outer plate with a plurality of cooling air supply holes over a first section and no holes over a second section;

forming an inner plate with a plurality of first impingement holes and a plurality of return air holes over a first section;

forming a plurality of second impingement holes in a second section of the inner plate;

forming a hollow standoff on a bottom side of the first section of the inner plate for each of the first impingement holes;

securing the inner plate over the cold side of the endwall with the first impingement holes over the first impingement surface and the second impingement holes over the second impingement surface;

securing the outer plate over the inner plate with the standoffs aligned with the first impingement cooling holes so that cooling air from the cooling air supply holes flows through the standoffs and the first impingement cooling holes to produce impingement cooling of the first impingement surface, then flows through the return air holes and around the standoffs and through the second impingement cooling holes to produce impingement cooling of the second impingement surface.

10. A double impingement cooling plate for sequential impingement cooling of a surface exposed to a hot gas flow, the double impingement cooling plate comprising:

an outer plate having a first section and a second section;

a plurality of air supply holes formed in the first section of the outer plate;

an inner plate of substantially the same shape as the outer plate and having a first section and a second section;

the inner plate having a plurality of first impingement cooling holes and a plurality of return air holes formed in the first section;

the inner plate having a plurality of second impingement cooling holes formed in the second section;

the first plate having a plurality of hollow standoffs extending from a bottom side of the first section and aligned with the plurality of air supply holes; and, the first plate and the second plate are bonded together such that the standoffs form a separate cooling air path for the first impingement cooling air from a return air path from the return air holes to the second impingement cooling holes.

11. The double impingement cooling plate of claim 10, and further comprising:

the return air holes have a larger diameter than the first impingement cooling holes.

12. The double impingement cooling plate of claim 10, and further comprising:

the outer plate and the inner plate are both rectangular in shape with a length in a direction of air flow between the two plates at least twice as much as a width of the two plates.

13. The double impingement cooling plate of claim 10, and further comprising:

the outer plate has a return air tube extending from an outer surface of the second section; and, the inner plate has a return air hole aligned with the return air tube of the outer plate.

14. A triple impingement cooling plate for sequential impingement cooling of a surface exposed to a hot gas flow, the triple impingement cooling plate comprising:

a first plate forming a first sealed space with an inner plate;

a second plate forming a second sealed space with the inner plate;

the first plate having a plurality of first impingement tubes extending in the first sealed space;

the inner plate having a plurality of first impingement cooling holes connected to the plurality of first impingement tubes;

the inner plate having a plurality of first return air holes connected to the first sealed space;

the second plate having a plurality of second impingement tubes extending in the second sealed space;

the inner plate having a plurality of second impingement cooling holes connected to the plurality of second impingement tubes;

the inner plate having a plurality of second return air holes connected to the second sealed space;

the inner plate having a plurality of third impingement cooling holes connected to the second sealed space; and, cooling air from outside the triple impingement cooling plate flows through the first impingement tubes and first impingement cooling holes, then flows through the first return air holes and around the first impingement tubes, and then through the second impingement tubes, then through the second impingement cooling holes, then flows through the second return air holes and around the second impingement tubes, and then flows through the third impingement cooling holes to produce a triple impingement cooling of the surface exposed to the hot gas flow.

15. The triple impingement cooling plate of claim 14, and further comprising:

the first plate forms the first sealed space with the second plate and the inner plate; and, the second plate forms the second sealed space with the inner plate.

16. The triple impingement cooling plate of claim 14, and further comprising:

the first plate forms the first sealed space with the inner plate; and, the second plate forms the second sealed space with the first plate and the inner plate.

* * * * *